United States Patent [19]

Langen et al.

[11] Patent Number: 4,879,860

[45] Date of Patent: Nov. 14, 1989

[54] CARTON LOADING MACHINES

[75] Inventors: Marinus J. M. Langen, Toronto; Peter Guttinger, Milton, both of Canada

[73] Assignee: H. J. Langen & Sons Limited, Mississauga, Canada

[21] Appl. No.: 264,074

[22] Filed: Oct. 28, 1988

[51] Int. Cl.[4] ..... B65B 1/04; B65B 5/06; B65B 39/00

[52] U.S. Cl. ..... 53/247; 53/260

[58] Field of Search ..... 53/247, 248, 260, 261, 53/539, 262, 263, 255

[56] References Cited

U.S. PATENT DOCUMENTS

| | | | |
|---|---|---|---|
| 3,546,837 | 12/1970 | Shuttleworth | 53/247 X |
| 3,673,756 | 7/1972 | Prete et al. | 53/248 X |
| 4,439,974 | 4/1984 | Wiseman | 53/261 X |
| 4,457,121 | 7/1984 | Johnson et al. | 53/248 X |
| 4,506,492 | 3/1985 | Boyd | 53/260 X |
| 4,534,156 | 8/1985 | Smith | 53/260 X |
| 4,570,413 | 2/1986 | Raudat | 53/260 X |
| 4,570,419 | 2/1986 | Tinsley | 53/260 X |
| 4,744,205 | 5/1988 | Probst | 53/248 X |

*Primary Examiner*—John Sipos
*Assistant Examiner*—Beth Bianca
*Attorney, Agent, or Firm*—Fetherstonhaugh & Co.

[57] ABSTRACT

A carton loading machine for use in loading items into a carton of the type which has two load storage compartments which are separated from one another by a divider wall and which has an end wall located opposite the divider wall. The carton loading machine has first and second loading stations arranged in a side-by-side relationship in which a carton is located with its divider wall separating the station. The loading machine has first and second gates mounted above the loading station for movement between a first position in which they are remote from loading station and a second position in which they extend into the first and second loading station respectively, one on either side of a divider wall of a carton to support the divider wall and guide load items into the load storage compartments.

7 Claims, 3 Drawing Sheets

CARTON LOADING MACHINES

BACKGROUND OF INVENTION

This invention relates to carton loading machines. In particular, this invention relates to carton loading machines of the type which are used to load cartons which have a divider wall panel which divides the interior space of the carton into at least two load storage compartments.

It is common to load items such as light bulbs into cartons which have two load storage compartments arranged in a side-by-side relationship which are separated from one another by a divider wall. The divider wall serves to prevent one of the load items making direct contact with the other and need not have a high degree of structural strength.

One of the difficulties which has been experienced in attempting to load cartons of this type is that as the load items are introduced into one compartment, the divider wall is deflected into the adjacent compartment and obstructs the loading of the adjacent compartment.

SUMMARY OF INVENTION

I have found that it is possible to overcome these difficulties and provide a simple and inexpensive form of carton loading machine which serves to rigidify the divider wall during the carton loading operation while assisting in guiding the load items into the compartment and centering the load compartment in the carton loading station.

According to one aspect of the present invention, there is provided in a carton loading machine for use in loading items into a carton of the type which has two load storage compartments which are separated from one another by a divider wall and which has an end wall located opposite the divider wall, each compartment having an entrance which opens therefrom which is located between the divider wall and one of the end walls, the carton loading machine having first and second loading stations arranged in a side-by-side relationship in which a carton is located with its divider wall separating the stations in use, the improvement of first and second gate members mounted above said loading station for movement between a first position in which the gate members are remote from loading station and a second position in which they extend into the first and second loading station respectively, one on either side of a divider wall of a carton in use to support the divider wall and guide load items into the load storage compartments.

BRIEF DESCRIPTION OF THE DRAWINGS

The invention will be more clearly understood after reference to the following detailed specification read in conjunction with the drawings wherein;

With reference to FIG. 1 of the drawings, the reference numeral 10 refers generally to a carton of the type which may be loaded in a carton loading machine of the present invention. The carton 10 has first and second load storage compartments 12 and 14 which are separated from one another by divider walls 16. The carton 10 also has end walls 18 and 20 which are located opposite the divider wall 16 and a front wall 22 and a back wall 24. The divider wall 16 is attached to the back wall 24 by means of a glue tab 26.

The specific structure of the carton is not important, however, the present invention is particularly suitable for use in association with a carton which has a divider wall 16 which is not firmly anchored with respect to the front and back walls and which is therefore free to be selected into one or other of the load storage compartments 12 and 14.

Figure 1:
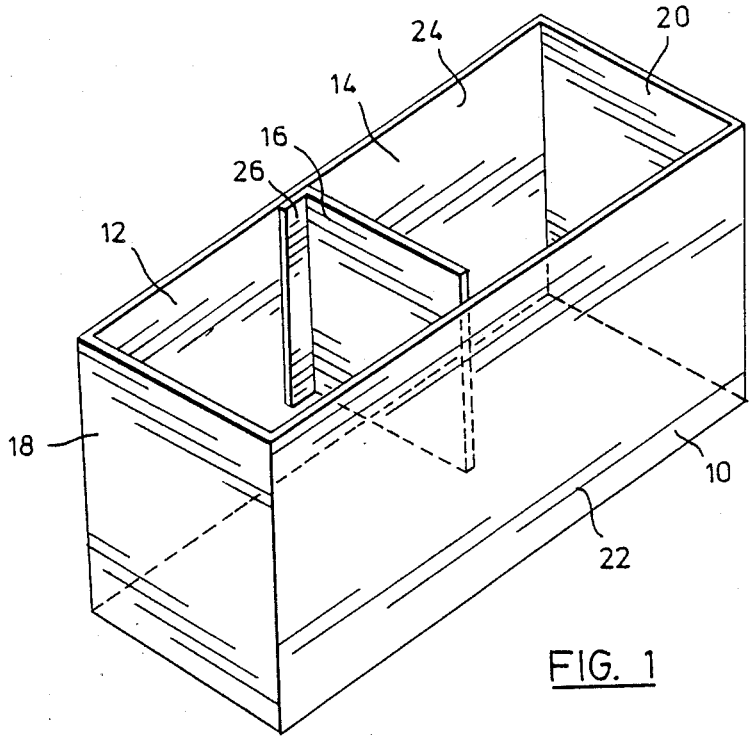
FIG. 1 is a pictorial view of a carton of the type which may be loaded by the carton loading machine of the present invention.
Figure 2:
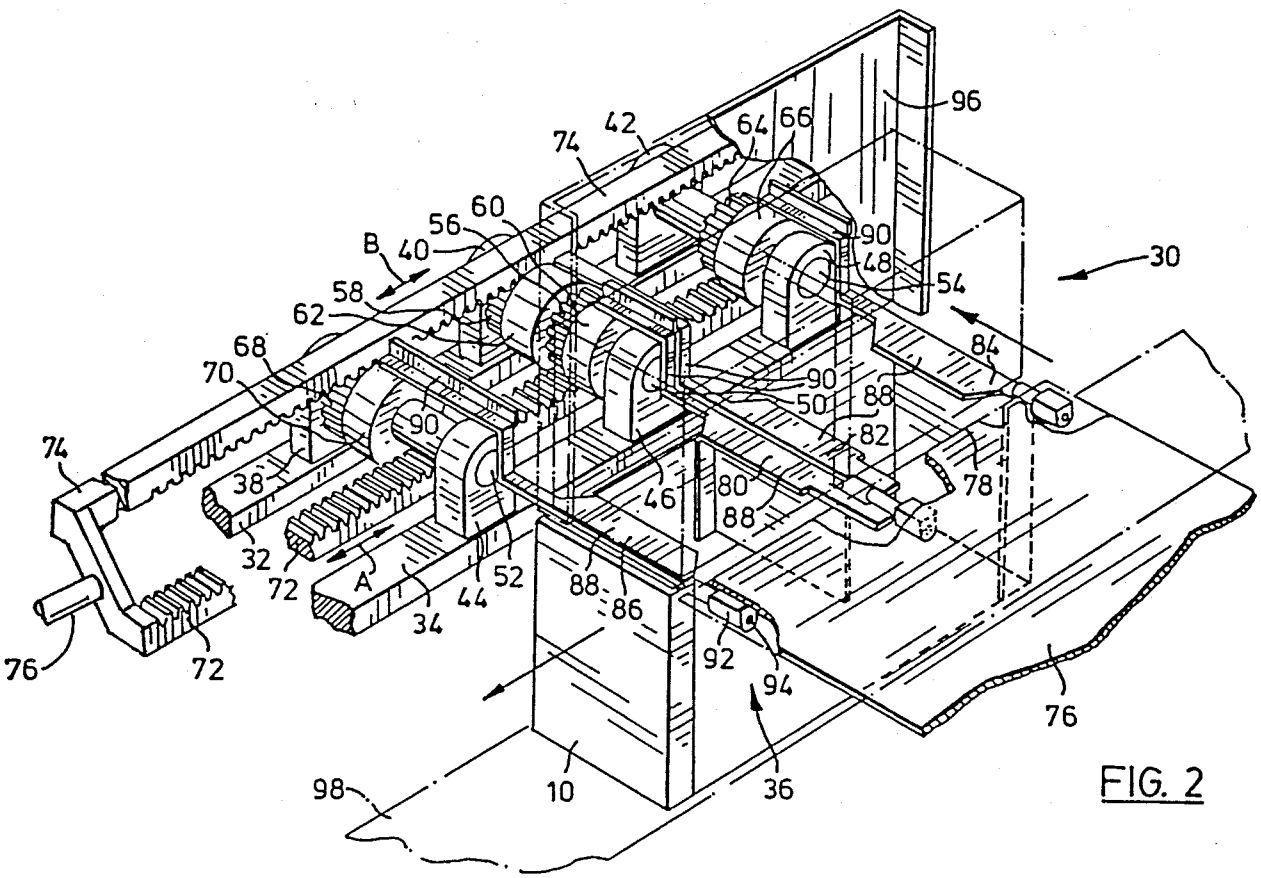
FIG. 2 is a pictorial view illustrating the gate mechanisn in its first position.

Carton loading machines of the type in association with which the carton loading mechanism of the present invention may be employed are well known and will not therefore be described in detail. The carton loading mechanism of the present invention is illustrated in FIG. 2 of the drawings and is generally identified by the reference numeral 30.

The mechanism includes a pair of beams 32, 34 which extend longitudinally through the carton loading station which is generally identified by the reference numeral 36. The beams 32 have support posts 38, 40 and 42 projecting upwardly therefrom and the beam 34 has support posts 44, 46 and 48 projecting upwardly therefrom. A first shaft 50 has its opposite ends mounted in the support posts 40 and 46. A second shaft 52 has its opposite ends mounted in the support posts 38 and 44 and a third shaft 54 has its opposite ends mounted in the supports posts 42 and 48. First and second pinions 56 and 58 are mounted for independent counter rotation on the shaft 50. A wheel 60 is connected to the pinion 56 and a wheel 62 is connected to the pinion 58 for rotation therewith. A third pinion 64 and its associated wheel 66 are mounted for rotation on the third shaft 54. A fourth pinion 68 and its associated wheel 70 are mounted for rotation on the second shaft 52.

A first rack 72 is mounted for longitudinal movement to and fro in the direction indicated by the double-head arrow A. The first rack 72 is meshed with the first pinion 56 and the third pinion 64. A second rack 74 is mounted for longitudinal reciprocating movement in the direction of the double headed arrow B. The second rack 74 is meshed with the second pinion 58 and the fourth pinion 68. The first and second racks 72 and 74 are connected to one another at one end thereof and are connected to a common power source through a shaft 76 so that they are simultaneously driven.

Figure 4:
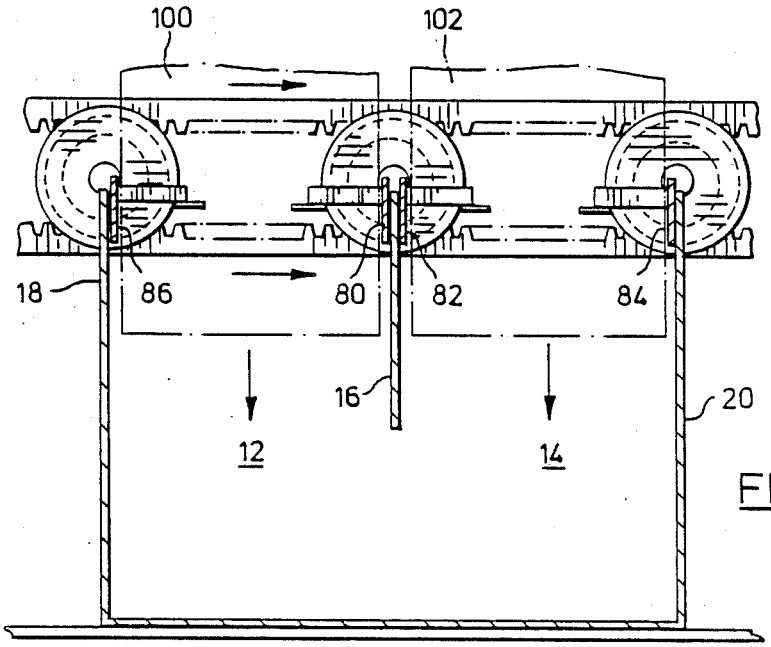
FIG. 4 is a front elevation similar to FIG. 3 showing the second position of the gates.

As a result of movement of the rack 72 from the right of the position shown in FIG. 4, the first pinion 56 and the third pinion 64 will be rotatably driven about the axes of the shafts 50 and 54 respectively to move in a counter-clockwise direction. The simultaneous movement of the second rack 74 will cause simultaneous rotation of the second pinion 58 and the fourth pinion 68 about the axes of the shafts 50 and 52 respectively in a clockwise direction.

A platform 76 extends toward the loading station 36 and has its outer edge 78 extending along one edge of the loading station 36.

A first gate member 80 is supported by the wheel 60 which is connected to the first pinion 56. A second gate member 82 is mounted on the wheel 62 which as previously indicated is connected to the second sprocket 58 for rotation therewith. Third and fourth gate members 84 and 86 are mounted on the wheels 66 and 70 respectively.

Each of the gate members 80, 82, 84 and 86 includes a blade portion 88 and an L-shaped arm 90. The L-shaped arm 90 serve to locate the proximal edge of the blade portions 88 in a position closely adjacent the axis of the shaft on which its associated wheel is mounted for rotation.

The outer ends of the gates 80, 82, 84 and 86 are pivotally mounted on support shafts 94 which are supported by the support blocks 92 which are mounted on the underside of the platform 76.

A face plate 96 is mounted so that it extends along the inner side edge of the loading station 36 opposite the platform 76.

Figure 3:
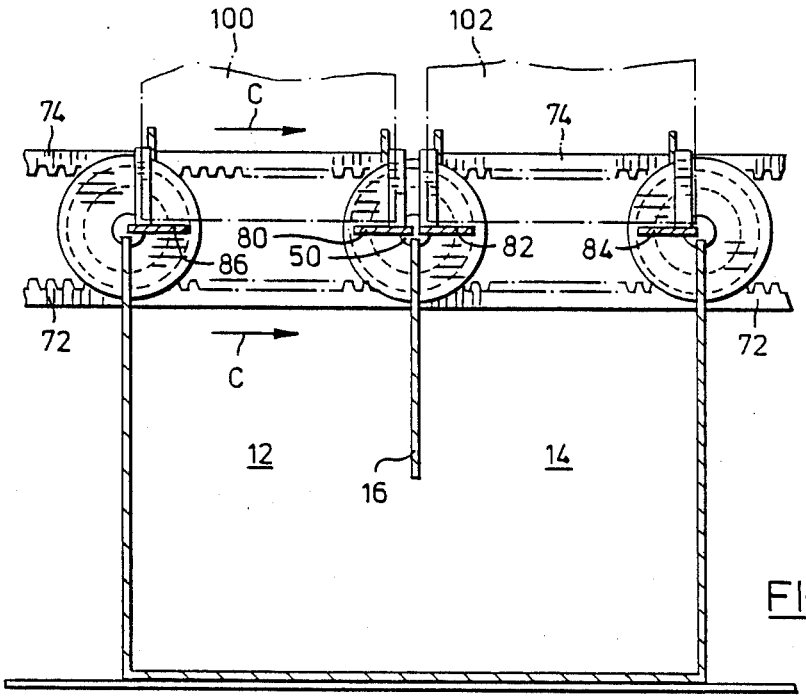
FIG. 3 is a sectional front elevation of the gate mechanism of FIG. 1.

In use, the blades 88 are located in the starting position illustrated in FIGS. 3 and 4. A carton 10 is conveyed into the loading station by means of a conveyor 98 and comes to rest in the position shown in FIGS. 3 and 4 of the drawings with the load storage compartment 12 located below the gates 80 and 86 and the load storage compartment 14 located below the gates 82 and 84. It will be noted that in this position, the divider wall 16 is located centrally between the gates 80 and 82 and is substantially aligned with the axis of the first shaft 50.

The racks 72 and 74 are then driven in the direction of the arrows C and as a result, the gates 80, 82, 84 and 86 move from the position shown in FIG. 3 to the position shown in FIG. 4. In this position, the first and second gates 80 and 82 are located one on either side of the divider wall 16 and the gates 84 and 86 are located inwardly of the end walls 20 and 18 respectively. When in this position, load items 100 and 102 may pass through the gates to enter the load storage compartments 12 and 14 respectively as shown in FIG. 4. The first and second gates 80 and 82 serve to retain the divider wall 16 in a central position and prevent lateral displacement of the wall as a result of contact with the load items as they enter the load storage compartments.

From the foregoing, it will be apparent that the present invention provides a simple and inexpensive carton support mechanism for use in a carton loading machine which will serve to support the carton in an opened position and guide the load item into the storage compartment.

Various modifications of the present invention will be apparent to those skilled in the art. It will be apparent that this mechanism can be modified for use when loading cartons which have three or more adjacent storage compartments each separated by a divider. In these circumstances, additional sets of gates will be mounted on a common shaft in the same manner that the first and second gates 82 are mounted for counter-rotation on the common shaft 50. The pinions which are connected to the gates which are mounted on the common shaft are meshed one with each rack to provide the counter rotation in response to movement of the racks.

These and other modifications will be apparent to those skilled in the art.

We claim:

1. In a carton loading machine for use in loading items into a carton of the type which has two load storage compartments which are separated from one another by a divider wall and which has an end wall located opposite the divider wall, each compartment having an entrance which opens therefrom which is located between the divider wall and one of the end walls, the carton loading machine having first and second loading stations arranged in a side-by-side relationship in which a carton is located with its divider wall separating the stations in use, the improvements of;

first and second gate members mounted above said loading stations for pivotal movement between a first position in which the gate members extend laterally inwardly with respect to one side of the divider wall and are located above the first and second loading stations respectively and a second position in which they extend into the first and second loading stations respectively, one on either side of a divider wall of a carton in use to support the divider wall and guide load items into the load storage compartments.

2. A carton loading machine as claimed in claim 1, further comprising third and fourth gate members located opposite the first and second members respectively, and mounted above the first and second load stations respectively, for pivotal movement between a first position in which the third and fourth gate members extend laterally inwardly with respect to an end wall of the carton and are located above the first and second loading stations respectively and a second position in which they extend downwardly into the first and second stations respectively, to be located in an inwardly overlying relationship with respect to an end wall of a carton which is located with its first and second storage compartments located in the first and second loading stations respectively to support the end walls of the carton and guide load items into the storage compartments.

3. A carton loading machine as claimed in claim 1, wherein said first and second gate members are mounted on first and second pinions respectively, said first and second pinions being mounted for counter-rotation about a first axis and first and second rack means meshed with said first and second pinion means respectively, said first and second rack means being slidably mounted for reciprocating longitudinal movement to rotatably drive said gates to and fro between said first and second position.

4. A carton loading machine as claimed in claim 2, wherein said first, second, third and fourth gate members are mounted on first, second, third and fourth pinions respectively, said first and second pinions being mounted for counter-rotation about a first axis and said third and fourth pinions being mounted for counter-rotation about second and third axes respectively, first rack means meshed with said first and third pinions and second rack means meshed with said second and fourth pinions, said first and second rack means being slidably mounted for reciprocating movement to rotatably drive said gates to and fro between said first and second positions.

5. A carton loading machine as claimed in claim 4, wherein said first and second racks are located on opposite sides of the first, second and third axes such that the longitudinal reciprocating movement of the racks in a common first direction causes rotation of the gates toward their second position and longitudinal movement of the racks in a common second direction causes rotation of the gates toward their first position.

6. A carton loading machine as claimed in claim 2, further comprising a support frame extending longitudinally with respect to the loading station at one side thereof, first, second and third shafts mounted on said frame with their axes aligned with said first, second and third axes respectively, said first, second, third and fourth gate members being mounted on first, second, third and fourth pinions respectively, said first and second pinions being mounted for counter-rotation on said first shaft, said third and fourth pinions being mounted for counter-rotation on said second and third shafts respectively, first rack means meshed with said first and third pinions and second rack means meshed with said second and fourth pinions, said first and second rack means being slidably mounted for reciprocating movement to rotatably drive said gates to and fro between said first and second positions.

7. A carton loading machine as claimed in claim 6, wherein the first and second racks are located on opposite sides of the first, second and third axes such that longitudinal movement of the racks in a common first direction causes rotation of the gates toward their second position and longitudinal movement of the racks in a common second direction causes rotation of the gates toward their first position.

* * * * *